United States Patent [19]

Kilman, Jr.

[11] 4,225,030

[45] Sep. 30, 1980

[54] AUTOMATIC INDICATOR FOR A GAME

[76] Inventor: Lowell E. Kilman, Jr., 3121 Keemont, Toledo, Ohio 43613

[21] Appl. No.: 952,474

[22] Filed: Oct. 18, 1978

[51] Int. Cl.[3] ..... G07F 17/32

[52] U.S. Cl. ..... 194/12; 235/92 GA; 235/92 CN; 340/381

[58] Field of Search ..... 194/1 R, 1 L–1 N, 194/9 R, 12, 16; 235/92 C, 92 CN, 92 GA; 340/323 R, 381; 200/DIG. 23, DIG. 3, 61.1; 362/95, 251; 307/12, 41, 143

[56] References Cited

U.S. PATENT DOCUMENTS

| | | | |
|---|---|---|---|
| 2,658,168 | 11/1953 | Matson | 194/12 X |
| 2,665,791 | 1/1954 | Caruso | 194/9 R |
| 3,731,066 | 5/1973 | Menke | 194/9 R X |

*Primary Examiner*—Stanley H. Tollberg
*Assistant Examiner*—Edward M. Wacyra
*Attorney, Agent, or Firm*—George R. Royer

[57] ABSTRACT

An electrical-mechanical device comprised of coin counters and electrical indicators to register and determine the number of plays or games a player has payed for, in coin, for a round of a given game; the subject device being comprised of a coin receptacle designed to receive and register a number of coins inserted for playing a number of games, with an electrical-mechanical register to indicate the exact number of coins placed in the receptacle for a given game. A master register control panel is provided for canceling any previously activated indicators after a given game.

3 Claims, 6 Drawing Figures

AUTOMATIC INDICATOR FOR A GAME

DISCUSSION OF PRIOR ART

Multiple player games of chance, such as bingo games have become a favorite pastime and many organizations now promote such games for fund raising purposes. Games such as bingo are of the type where each player can on a given round, pay for and play a plurality of unit games simultaneously, the exact number of which being dependent on the desires of the player.

However, there have been many problems encountered with the use of games, such as bingo, for fund rasing purposes. Aside from the problem of close scrutiny by state agencies, there is the difficulty of maintaining an accounting of the receipts both on an individual game basis and for an entire day. Generally, reports of receipts must be made to interested state agencies which serve to audit the fund activity. In this latter regard, many state agencies have encountered the problem whereby individual bingo operators do not report all funds received in bingo operations on a given day or over a given period.

Moreover, similar problems have been encountered by the individual bingo operator, since individual workers at a bingo game may frequently divert funds to their own use. Obviously, this problem can lead to a significant shortage of funds which causes a pejorative situation relative to the accounting problem. In specific reference to the problem of individual workers diverting money in a given single game of bingo or similar games, individual players buy cards to play one or more games by giving the appropriate amount of money to a collector for a corresponding number of cards or plays for a given round. In the usual play situation there is a series of games played over a given time, perhaps an evening, for example. Usually one player will use the same cards over repeatedly during the same evening. This latter aspect aids a player who could cheat by allowing the player to surreptitiously use one or more cards even though the card has not been purchased for each new round. A worker collecting money must rely on his memory in order to determine who has paid to play a given number of cards for a given round in the series. If in addition to the problem of a worker's faulty memory as to the amount of monies collected for cards played, there may be a propensity to steal from the funds he receives, the problems above are correspondingly compounded. Thus, there is a need to control all money input for game operations in order to avoid the problems discussed. This invention is directed to that end.

OBJECTS

Yet another object of this invention is to provide an improved system for controlling game operations involving money transfers;

It is also an object of this invention to provide an improved game device;

Another object of this invention is to provide an improved control system for bingo game operators;

It is yet another object of this invention to provide an improved financial control system for games wherein multiple players can each play a plurality of games simultaneously;

Yet another object of the subject invention is to provide an auxiliary device for monitoring the number of games paid for by a player for the game;

Other and further objects of the subject invention will become manifest from a reading of the following description taken in conjunction with the drawings.

GENERAL DESCRIPTION OF THE INVENTION

Figure 1:
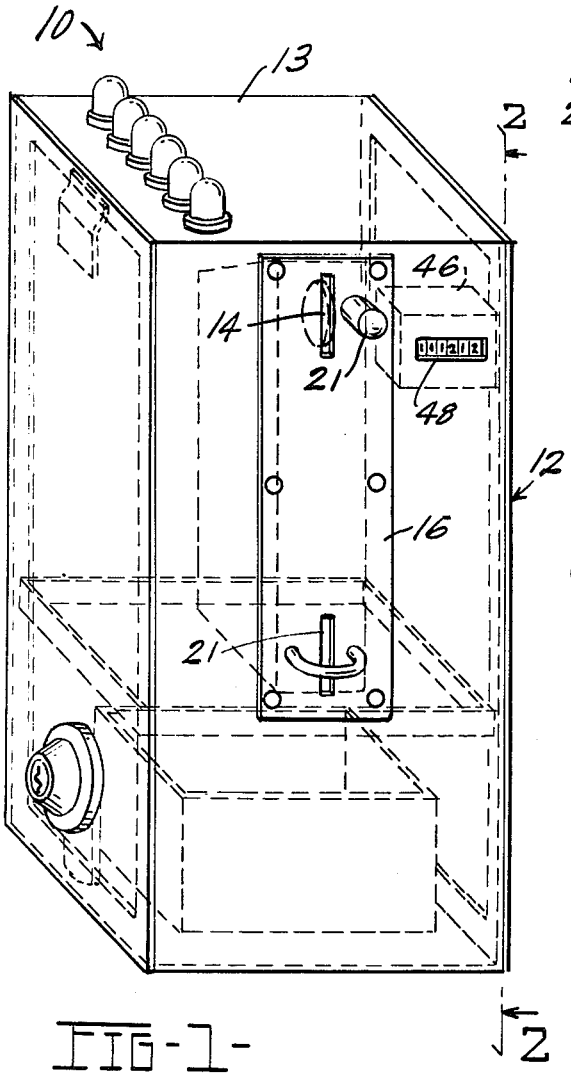
FIG. 1 is a perspective view, in section, of the coin receptacle.

The subject invention is an electrical control device for games, particularly a bingo game, comprised of an electrical system for registering coin input for a game play, with lights to indicate the number of coins inserted for a given game, and a counting device to register the number of plays accumulated over a given period. The device is comprised of an integrally housed unit, which in turn includes counter mechanism, a coin relay, a program control unit and an electrical indicator for displaying the number of plays paid for in coin. A remote cutoff switch not included in the unit serves to cut off all electrical input at the end of a game play to start new game play.

DESCRIPTION OF PREFERRED EMBODIMENT

Referring now to the drawings in which a preferred embodiment is shown, the following description is of a particular embodiment as applied to a bingo game, however the scope of this invention should not be construed to be limited to only bingo games. The concepts herein can be applied to other games of similar play sequences.

The invention is generally comprised of a coin receptacle 10, shown in FIG. 1, structured to receive a multiple number of coins. This coin receptacle 10 houses almost all the key elements of the subject invention. Moreover, such individual receptacle 10 is normally situated at each player's location, during game play, and is designed to accommodate and register each player's coin input for bingo play operations. As a result, every bingo player will have a coin input assembly 10 for the play of bingo for given game rounds.

Further describing the particular features of coin receptacle 10, a parallelopiped shape box-like cover 12 serves to house the internal components of coin receptacle 10. Located on the upper surface 18 of the box 12 of the coin receptacle 10 is a coin receiver slot 14, particularly adapted for receiving coins of a twenty-five cent denomination, however the coin receptacle 10 can be readily adapted to receive and register coins of other denominations, depending on the exact financial desires of the game operator. Located within the cover box 12 is a coin register box 16, said box being rectangularly shaped and conjoined to the inside cover of box 12 just adjacent to the coin receptacle 14.

Figure 2:
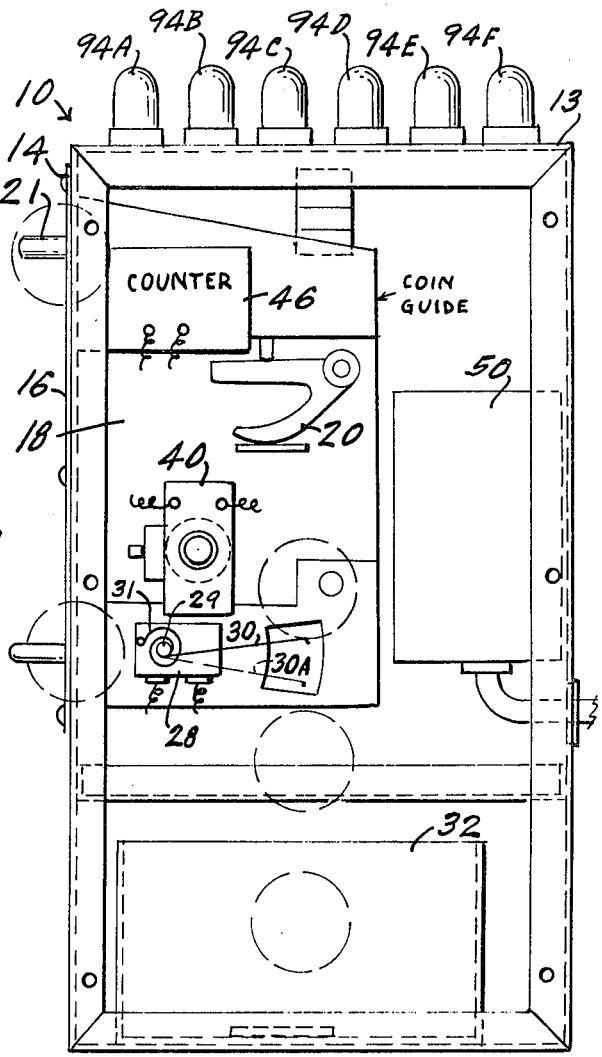
FIG. 2 is a side elevational view in section of the coin receptacle.

As a coin is placed into slot 14, it will descend, by gravitational force, downwardly through the inner chamber 18 of box 16. A spring loaded lever arm 20, located in chamber 18, projects into the upper part of inner chamber 18, as shown in FIG. 2. Said lever 20 serves as a coin return lever, when coin return button 21 is depressed, it serves to activate lever 20 for coin returns through chamber 18 directly to coin return outlet 21.

Located adjacent the bottom of chamber 18 in coin register box 16 is a coin register switch 28, which is equipped with a rotatably mounted lever arm 30. Lever arm 30 is appropriately restrained, by a spring mechanism or other similar device, from downward movement beyond positon 30A shown in FIG. 2. Accordingly, as a coin of predetermined size falls downwardly from the coin insert 14 it will continue to fall through chamber 18 in box 16, to strike lever arm 30, depressing it momentarily downwardly to position 30A, as represented, and thence the coin falls into coin storage box 32 situated at the very bottom of box 16. More specifically, referring to FIGS. 1 and 2, there is integrally and rotatably mounted on coin register switch mechanism 28 a lever arm 30 designed for limited rotation counterclockwise about a pivot point 29, as shown. A coil spring 31 is seated at pivot point 29. This coil spring 31 serves to resiliently restrain and then return the lever arm 30 to the upright position after a coin of suitable size passes over the lever arm 30, causing it to rotate counterclockwise or downwardly as graphically represented in FIG. 2 to a position shown in phantom, indicated as 30A. After the coin passes completely over the end of lever 30 and depresses the lever 30 to position 30A, it passes over the end of arm 30 and downwardly into the bottom of coin storage chamber 32. Coins are stored in box 32 for removal by the operator at will.

Referring again to FIG. 2, when lever arm 30, in switch 28, rotates counterclockwise, as described above, the impressment and passing weight of a coin causes the end of lever arm 30 adjacent pivot point 29 to actuate the microswitch rotor mechanism, not shown, of switch 28. Coin register switch 28, other than the foregoing described structure, is a conventional switching device, preferably a microswitch, which when closed momentarily by the above described movement of lever arm 30, in turn activates relay 40. Relay 40 in turn generates electrical signals to electrical mechanical counter device 46, shown in FIGS. 1 and 2. Counter 46 is a conventional mechanical digital counter serving to register total coin input over a given duration.

Figure 3:
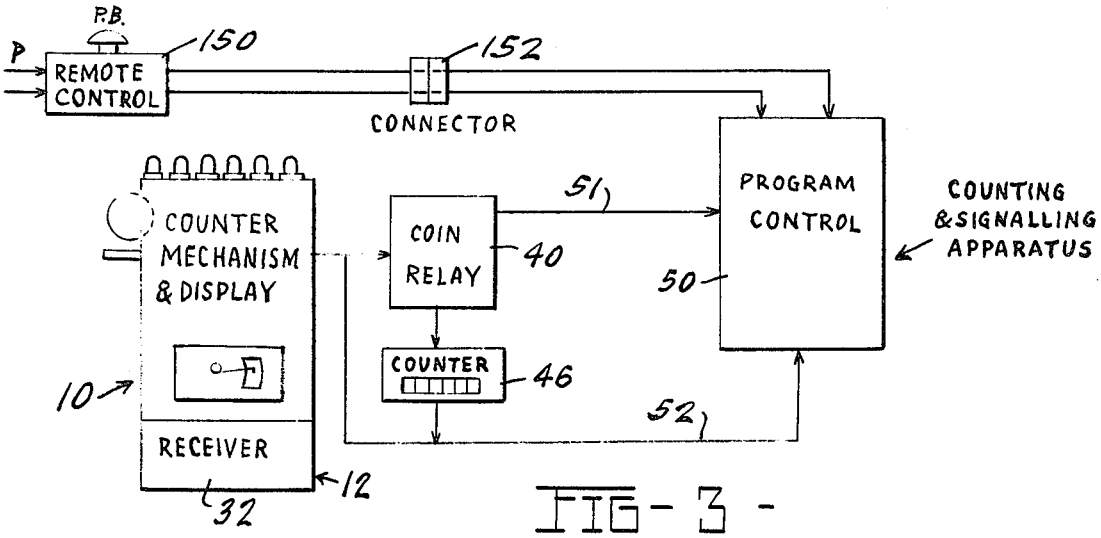
FIG. 3 is a schematic view of the electrical-mechanical system.
Figure 4:
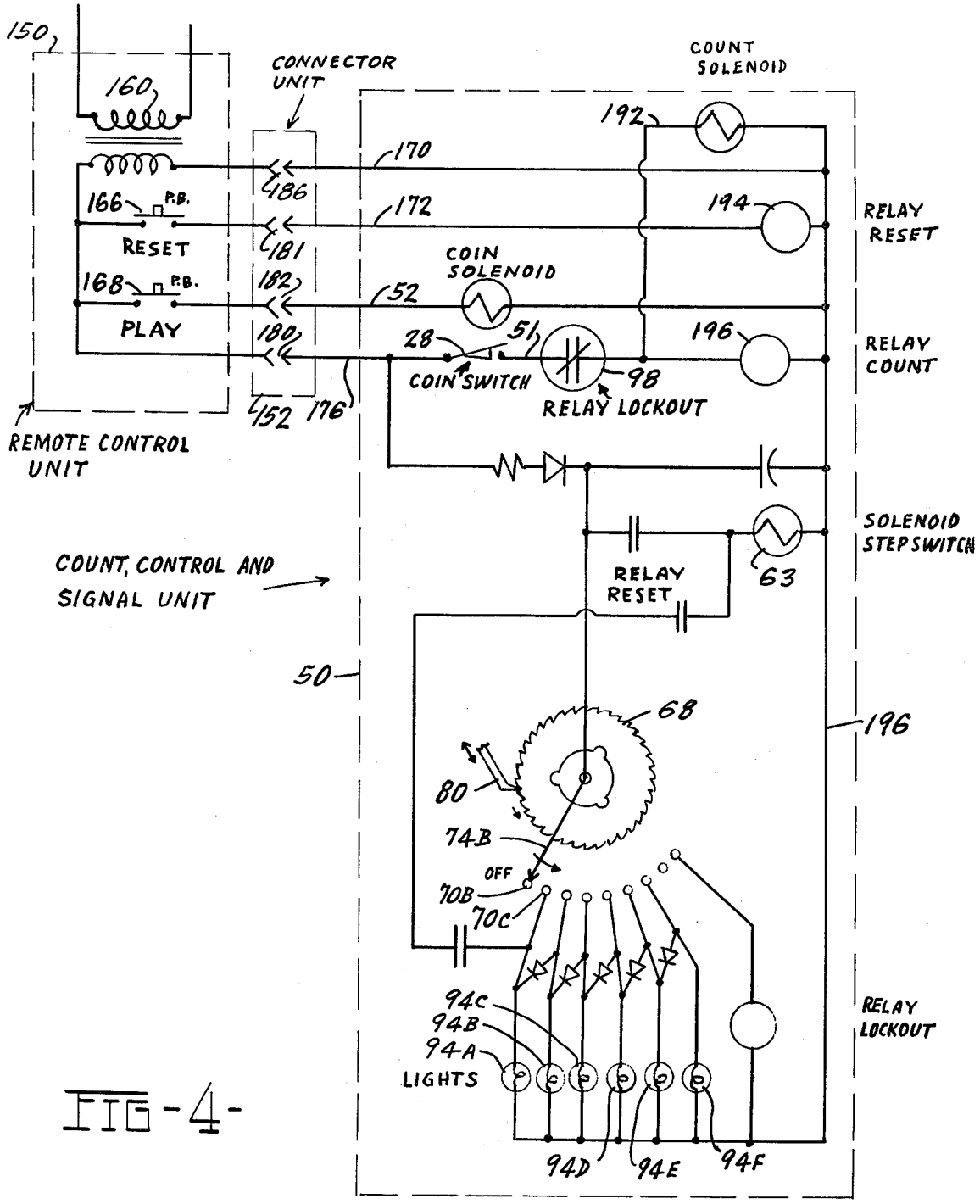
FIG. 4 is a schematic circuit diagram of the complete electrical assembly used in the subject device.

Referring now to FIGS. 2, 3, and 4, coin register switch 28 is connected by an appropriate electrical lead to a program control unit 50 also located in box 12, as shown. More particularly, lead 51 extending between coin relay 40 and program control unit 50 serves as a parallel connection with lead 52 extending to program control unit 50, as represented in FIG. 3. Therefore, movement of coin register switch 28 causes coin relay 40 to activate counter 46 and simultaneously generates an electrical signal to program control unit 50 for generation of display units therein, as more fully described hereinbelow.

Figure 5:
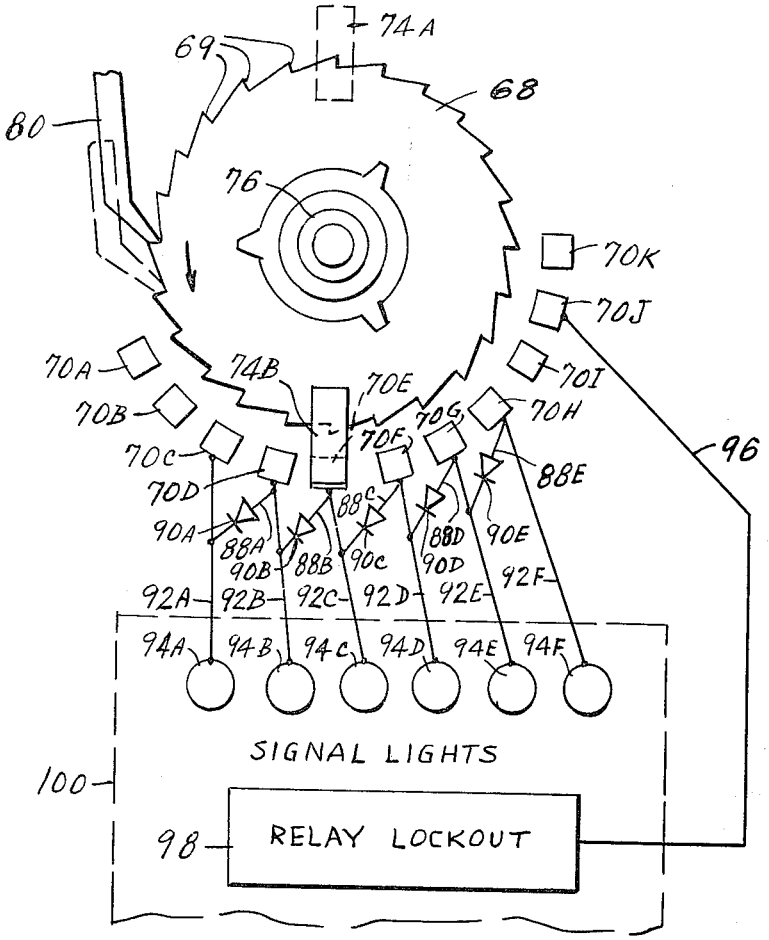
FIG. 5 is an elevation view of the multiple switching mechanism, partially in schematic.

The program control unit 50 is comprised primarily of a multiple point stepper switching device 60, hereinafter referred to as multiple switching device 60, and electrical panel lights 94A, 94B . . . 94F, as shown, and relay lockout 98. The functional interrelationship of these units is more fully described as follows:

Multiple switching device 60 is comprised of solenoid drive unit 63, represented schematically in FIG. 4. This solenoid drive 63 is contained in cylindrical housing 62, shown in perspective in FIG. 6. Moreover, solenoid drive unit 63 is activated, through electrical signals received from movement of coin register switch 28, to rotate in successive incremental movements a ratchet wheel 68. The circumferential periphery of ratchet wheel 68 is a plurality of conventionally shaped and disposed ratchet teeth 69, as seen in FIG. 5. Engaging respective ratchet teeth is ratchet arm 80, serving to activate the rotational movement of ratchet wheel 68, as it rotates counterclockwise about shaft 76.

Figure 6:
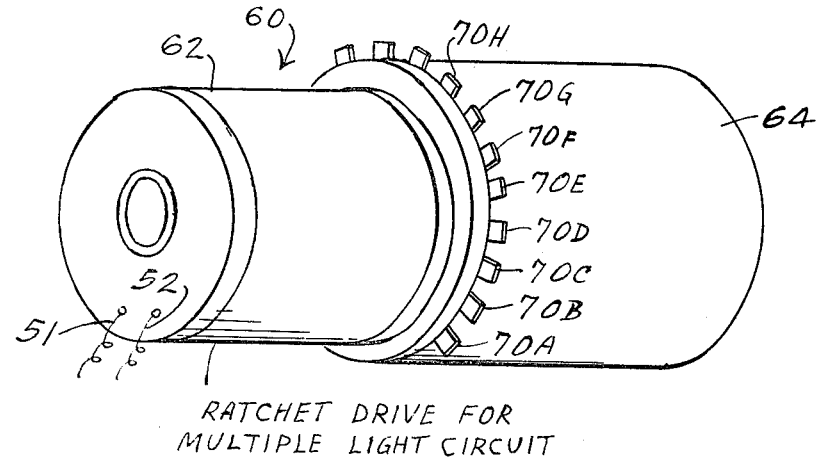
FIG. 6 is a perspective view of the multiple switching mechanism housing.

Located on the circumferential periphery of ratchet wheel 68 are two radially extending contact arms 74A and 74B. As shown in FIG. 5, these radially extending arms 74A and 74B are diametrically opposed, being aligned with one another along a common diameter one hundred and eighty degrees apart. Contact arms 74A and 74B function, as each extends beyond the peripheral extreme of adjacent ratchet teeth, serve to contact a series of pressure actuated switches 70A, 70B . . . 70K as represented in FIG. 5. Switches 70A, 70B . . . 70K are arranged in a semicircular order in housing 64 just beyond the outer periphery of ratchet teeth 69, as represented in FIGS. 5 and 6. Moreover, each switch 70A, 70B . . . 70K is spaced equal distance from each adjacent switch, said spacing being equivalent in arcuate distance to the single rotational movement of ratchet wheel 68. Thus, as contact arm 74B, for example, moves successively with incremental movements of ratchet wheel 68 over switch 70A to switch 70B, and so forth, it will activate by presssing contact, each such successive switch 74A, 74B . . . 74K, in sequential order as represented. After ratchet wheel 68 makes a 180° movement, contact arm 74A functions in similar fashion to contact arm 74B for the remaining one-half revolutionary movement of ratchet wheel 68.

Switches 70C, 70D . . . 70H are each connected to corresponding lights 94A, 94B . . . 94F, as shown, As each switch 70C, 70D . . . and 70H is impressed, the corresponding lights 94A, 94B . . . 94F are activated through intermediate circuit corrections 92A, 92B . . . 92F, as shown in FIG. 5. It must be noted that switches 70A, 70B, 70J, and 70K are not connected to any lights, as shown in the drawings. These switches 70A, 70B, 70J and 70K serve as extra switches or bypasses in the embodiment shown in the drawings. Swith, 70J, serves to activate relay lockout 98, through lead 96. Relay lockout 98 functions to cut off all electrical signals to electrical lights 94A, 94B . . . 94F upon movement of the contact arm through the seventh and eighth switch position, since in the embodiment shown in FIG. 5, only six lights are used for up to six plays of a given game.

Turning attention again to the electrical connections between switches 70C, 70D . . . 70H, and the corresponding lights, it is necessary once a switch is activated to turn on a corresponding light, such as light 94A, that such light remains on when additional coins are placed in the coin receptacle for further game plays.

In order to fulfill this purpose, diode rectifiers are placed between respective switches in order to maintain the energized state on all prior light circuits. Thus, located between switch 70D and light 94A is diode 90A on lead 88A; located between switch 70E and and light 94B is diode 90B on lead 88B. Similarly, diodes 90C, 90D and 90E are located between the remaining switch junctures, as shown. By the foregoing structure, each light 94A, 94B . . . 94F, once energized will remain so as the contact arm moves successively to each correspondingly successive switch position.

Generally, represented in the schematic view shown in FIG. 4, is the overall electrical mechanical operation. A remote control unit 150, with transformer 160, and reset switches 166 and 168, is joined to the rest of the unit through connector unit 152, containing plugs 180, 182, and 186. Electrical leads 170, 172, 52, and 176 serve as appropriate connections for transmission of voltage to operate all remaining parts of the unit, including solenoids 40 and 63.

The foregoing described structure, while directed to a specific embodiment is only one of many embodiments the subject invention can assume, and the foregoing description should not be considered as a limitation on the following claims.

I claim:

1. An automatic indicator for a game having a plurality of individual plays per person, said indicator having electrical means to record games paid for in coin and functioning to display electrically and automatically the exact number of plays paid for by an individual player, comprising:

(a) a coin receptacle for receiving a plurality of coins in succession;

(b) mechanical switching means in said coin receptacle for registering each successive coin input into said coin receptacle;

(c) electrical relay means in said coin receptacle and connected to said mechanical switching means, said electrical relay means activated by said mechanical switching means;

(d) multiple mechanical switching means in said coin receptacle connected to said electrical relay means, said multiple switching means comprising a plurality of successively positioned switches which are activated in succession upon successive individual signals emanating from the mechanical switching means through said electrical relay means;

(e) a plurality of electrically activated lights each connected to a respective individual switch in said multiple switching means, wherein each light is activated when a corresponding switch is closed; and (f) a plurality of diode rectifiers connected to said multiple mechanical switching means and each of the electrically activated light means, said diode rectifiers serving to hold an electrical signal to the previously energized light.

2. An automatic indicator for a game as described in claim 1 in which the successive switches in the multiple switching means are arranged in semi-circular order.

3. An automatic indicator for a game having a plurality of individual plays per person, said indicator having electrical means to record games paid for in coin and functioning to display electrically and automatically the exact number of plays paid for by an individual player responsive to the number of coins deposited, comprising the following improvements:

(a) a plurality of successively electrically lighted members integrally disposed on the outside of said indicator;

(b) a plurality of diode rectifier means integrally connected to the electrical means, each of said diode rectifier means specifically receiving an input from said electrical means, with output means to at least one of said successively lighted members, whereby a previously lighted member is continued to be lighted after successive coin inserts.

* * * * *